United States Patent [19]

Banich, Sr.

[11] 4,346,812

[45] Aug. 31, 1982

[54] PLASTIC CLOSURE WITH REINFORCED CENTRAL PANEL

[75] Inventor: John N. Banich, Sr., Chicago, Ill.

[73] Assignee: The Continental Group, Inc., Stamford, Conn.

[21] Appl. No.: 242,197

[22] Filed: Mar. 10, 1981

[51] Int. Cl.[3] ..... B65D 53/02

[52] U.S. Cl. ..... 215/352

[58] Field of Search ..... 215/352, 343, 345, 354

[56] References Cited

U.S. PATENT DOCUMENTS 2,942,747 6/1960 Towns ..... 215/354 X 3,390,800 7/1968 Simons ..... 215/352

FOREIGN PATENT DOCUMENTS 676486 6/1966 Belgium ..... 215/352

*Primary Examiner*—Donald F. Norton

*Attorney, Agent, or Firm*—Charles E. Brown

[57] ABSTRACT

A closure for packaging products in a container under pressure conditions other than atmospheric. "Doming" or depression of the central panel portion of the closure end wall is prevented by a rib reinforcement.

3 Claims, 4 Drawing Figures

PLASTIC CLOSURE WITH REINFORCED CENTRAL PANEL

This invention relates in general to new and useful improvements in closures for containers, and more particularly to a closure for carbonated beverage containers wherein the closures are formed of plastic material.

When plastic closures are subjected to internal pressure such as would occur with a carbonated beverage package, the closures have a tendency to "dome". The complete package is subjected to shipment and warehouse storage where the surrounding temperature can rise beyond normal room temperature and, in turn, the internal package pressure rises and the closure "doming" becomes noticeable. This closure "doming" can be disturbed by the application of price coating in the store or by a product stacking during shipment and storage. When the "doming" is disturbed, package venting or carbonation leakage can occur. As will be apparent, the loss of carbonation is objectionable to the customer, and such packages will be a product loss for the packer when the package is returned for lack of carbonation.

It has been found that with the use of only a slight additional weight of material in the form of bridging or reinforcing ribs, the required strength to minimize "doming" due to increased internal package pressures is obtainable.

The strengthening ribs are particularly adaptable to be used in combination with plastic closures wherein there is provided a separately formed and usually a flowed-in liner is utilized as a sealing member. Such closures have formed on the underside of the end wall thereof an annular pocket or seat for the liner with the pocket or seat being defined by a depending annular rib. The rib generally defines the central panel portion of the end wall surrounding the contact between the liner and the bottle neck finish and cooperates with the ribs to strengthen the end wall.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
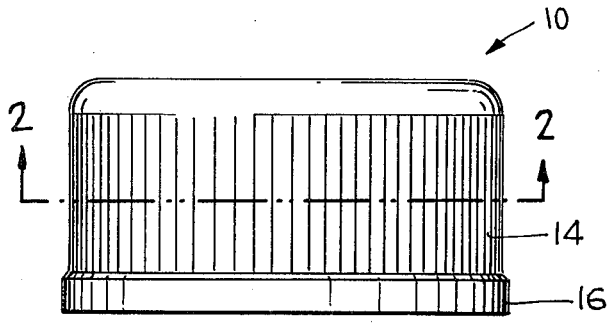
FIG. 1 is a side elevational view of a closure cap formed in accordance with this invention.

Referring now to the drawings in detail, it will be seen that there is illustrated a closure formed in accordance with this invention, the closure being identified by the numeral 10. The closure 10 is injection molded of a suitable plastic material and includes an end wall 12 and a depending skirt 14. If desired, the lower edge of the skirt may be reinforced by a thickened rim 16.

The illustrated closure is intended to be utilized in conjunction with a container neck finish which is externally threaded, and thus is provided with internal threads 18.

In order that a seal may be formed between the closure and the sealing lip (not shown) of a container neck finish, the underside of the end wall 12 which is within the skirt 14 is provided with an annular liner 20. The liner 20, as far as this invention is concerned, may be of any construction but is preferably of the flowed-in type. To this end, the closure 12 is provided with an annular pocket 22 on the underside of the end wall 12. The radially inner and outer edges of the pocket 22 are defined by an annular rib 24 depending from the end wall 12 and the inner surface of the skirt 14.

It will be seen that when the closure 10 is applied to a container neck finish in the normal manner and the liner 20 seats on and forms a seal with the terminal sealing surface of the container, internal pressures within the container are directed against the underside of the end wall 12 in general and most specifically to the central panel portion which is defined by and is within the annular rib 24. This central panel portion, identified by the numeral 26, is subjected to a beam-like bending action or "doming" as discussed above. The net result is that the liner 20 has generally pivoted relative to the sealing surface of the container end finish and then, when the "domed" central panel portion is flattened by way of a pressure applied against the uppermost surface thereof, there is a deflection of the end wall 12 in the area of the liner such that there is leakage between the liner and the sealing surface of the container which results in a loss of pressure and most particularly carbonation in the event of a carbonated beverage being packaged.

Figure 2:
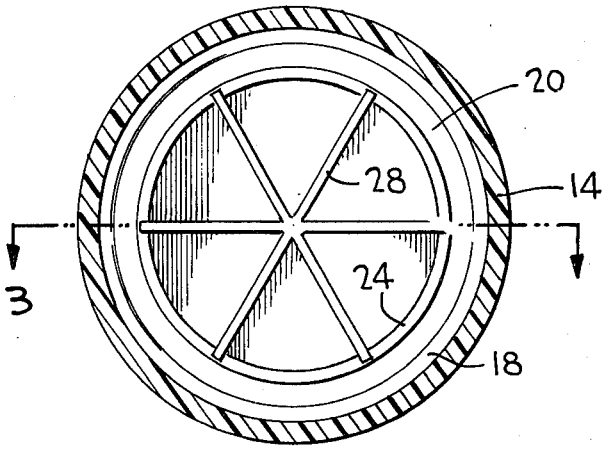
FIG. 2 is a horizontal sectional view taken generally along the line 2—2 of FIG. 1, and shows the internal details of the closure.

In accordance with this invention, it is proposed to supplement the reinforcing function of the annular rib 24 by providing transverse ribs, such as the ribs 28 shown in FIG. 2. It is preferred that the ribs be radiating ribs and that they intersect at the center of the central panel 26 and extend therefrom to the annular rib 24. While it has been found that six ribs appear to provide the best results, it has also been found that three ribs are the minimum number to minimize "doming" of the end wall 12.

Figure 3:
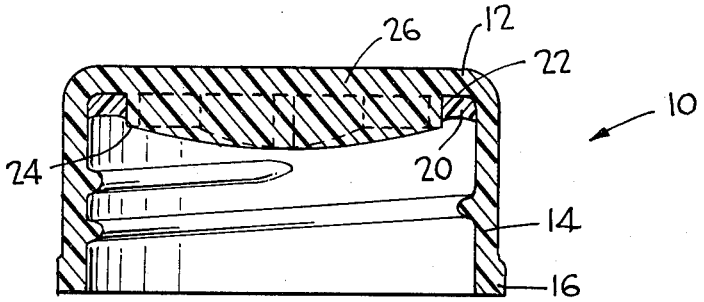
FIG. 3 is a vertical sectional view taken generally along the line 3—3 of FIG. 2, and shows specifically the cross section of the closure including the outline of a typical rib.

In FIG. 3, the ribs 28 are illustrated as being downwardly bowed so as to be of maximum thickness at their points of intersection. On the other hand, it has been found that ribs, such as the ribs **28*a* of FIG. 4**, may be centrally upwardly bowed so as to be of minimum thickness at their liner intersection.

Figure 4:
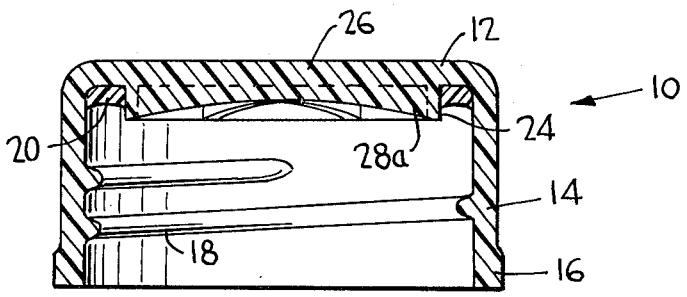
FIG. 4 is a sectional view similar to FIG. 3, and shows a modified rib configuration.

While the rib outlines of FIGS. 3 and 4 are the preferred outlines, it is also to be understood that the ribs can be straight although the sloping configurations are preferred, and while the arcuate sloping configurations are preferred straight line sloping configurations have also proven satisfactory.

It is to be understood that while the closure 10 is primarily suited for use in conjunction with internally pressurized packages, the closure 10 may also be beneficially utilized when the product is packaged under vacuum conditions. The ribs also prevent the internal deflection of the central panel portion 26 which, under certain conditions, can result in the breaking of the seal between the liner and the container neck finish and the loss of internal vacuum.

Although only several preferred embodiments of the invention have been specifically illustrated and described herein, it is to be understood that minor variations may be made in the closure reinforcement arrangement without departing from the spirit and scope of the invention as defined by the appended claims.

I claim:

1. A closure cap for carbonated beverages and like products packaged at a pressure other than atmospheric, said closure cap being of a molded plastic material construction and comprising an end wall and a depending skirt, an annular sealing ring seated on an underside of said end wall adjacent said skirt and surrounding a central panel of said end wall, and reinforcing means integral with said end wall and in the general area of said central panel, said end wall having on said underside an annular seat for said sealing ring with said annular seat being in part defined by a depending annular rib, and said reinforcing means being on said underside of said end wall within said annular rib, said reinforcing means being in the form of radiating ribs intersecting at the center of said central panel and extending radially outwardly to said annular rib, said radiating ribs being of substantially the same height as said annular rib at their intersections with said annular rib.

2. A closure cap according to claim 1 wherein said radiating ribs have lower edges which are convexly curved in elevation.

3. A closure cap according to claim 1 wherein said radiating ribs have lower edges which are concavely curved in elevation.

* * * * *